US006808336B2

(12) United States Patent
Fervers et al.

(10) Patent No.: US 6,808,336 B2
(45) Date of Patent: Oct. 26, 2004

(54) OSCILLATION DETECTING DEVICE FOR COMPACTING SOIL

(75) Inventors: Wolfgang Fervers, Munich (DE); Thomas Maurer, Munich (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/257,837

(22) PCT Filed: Apr. 12, 2001

(86) PCT No.: PCT/EP01/04243

§ 371 (c)(1),
(2), (4) Date: Apr. 21, 2003

(87) PCT Pub. No.: WO01/81680

PCT Pub. Date: Nov. 1, 2001

(65) Prior Publication Data

US 2003/0156491 A1 Aug. 21, 2003

(30) Foreign Application Priority Data

Apr. 20, 2000 (DE) ..... 100 19 806

(51) Int. Cl.[7] ..... E01C 19/38
(52) U.S. Cl. ..... 404/117; 404/133.1
(58) Field of Search ..... 404/117, 72, 75, 404/133.05, 133.1, 133.2

(56) References Cited

U.S. PATENT DOCUMENTS

| | | | | |
|---|---|---|---|---|
| 3,153,993 A | | 10/1964 | Keppler | |
| 3,775,019 A | | 11/1973 | Konig et al. | |
| 4,330,738 A | | 5/1982 | Paramythioti et al. | |
| 4,382,715 A | * | 5/1983 | Vural et al. | 404/133.05 |
| 4,412,757 A | * | 11/1983 | Kummel et al. | 404/113 |
| 5,261,762 A | * | 11/1993 | Yamaguchi | 404/133.05 |
| 5,695,298 A | * | 12/1997 | Sandstrom | 404/72 |
| 5,984,572 A | * | 11/1999 | Mitsui | 404/117 |
| 6,431,790 B1 | * | 8/2002 | Anderegg et al. | 404/75 |
| 2004/0009039 A1 | * | 1/2004 | Corcoran et al. | 404/117 |

FOREIGN PATENT DOCUMENTS

DE 2 007 448 9/1970

* cited by examiner

*Primary Examiner*—Robert E Pezzuto
*Assistant Examiner*—Alexandra Pechhold
(74) *Attorney, Agent, or Firm*—Boyle Fredrickson Newholm Stein & Gratz S.C.

(57) ABSTRACT

A device for compacting the soil comprising a soil contact element which is impinged upon by an oscillation exciter enabling the soil to be compacted. The soil contact element is elastically coupled to an upper mass. The upper mass is used as a detection mass, whereby the acceleration thereof is detected by an acceleration sensor. A measuring signal emitted by the acceleration sensor is evaluated in a control device which controls the oscillation exciter according to a deviation from a set value.

18 Claims, 1 Drawing Sheet

OSCILLATION DETECTING DEVICE FOR COMPACTING SOIL

BACKGROUND OF THE INVENTION

The invention relates to a soil-compacting device comprising a soil contact element actuated by a vibration generator for the purpose of soil compaction.

DESCRIPTION OF THE RELATED ART

Such a soil-compacting device, for example a vibrating plate or vibrating roller, is usually composed of two masses coupled elastically relative to one another, specifically a lower mass and an upper mass. The lower mass substantially comprises a soil contact element which is actuated by a vibration generator. The upper mass usually carries a drive for the vibration generator and is connected to the lower mass via spring elements. Vibration generators which have proved to be useful in the past have been unbalanced generators in which one or two shafts bearing unbalanced masses are set in rotation. The vibration produced thereby, which, if required, can also be set in different directions, is introduced into the soil contact element and used for the compaction of soils. The structure described is generally known, in particular in connection with vibrating plates or vibrating rollers, so that a further description is not necessary.

In the case of such soil-compacting devices, the vibration generators usually produce a vibration with constant frequency and amplitude. In addition, there are known vibrating plates in which, although a stepped or stepless adjustment of frequency and/or amplitude is possible, the adjustment is the sole responsibility of the operator. Since the optimum parameters for soil compaction can constantly change during the compaction operation on account of different soil characteristics, and since the operator is not able to constantly detect these parameters and translate them into a corresponding adjustment of the vibration generator, the vibration parameters are generally not matched to the particular properties of the ground. In this respect, the problem may occur in particular that the soil-compacting device starts to jump if the soil to be compacted does not have sufficient deformability. Jumping of the soil-compacting device leads to a rapid increase in machine wear and in environmental noise pollution and puts a strain on the operator. In addition, jumping of the soil-compacting device can cause the soil to loosen up again. WO98/17865 discloses a method of measuring mechanical data of a soil for a soil-compacting device. Described therein is a vibrating roller whose roller tire, together with the soil to be compacted, is regarded as a compaction vibration system whose vibration behavior is detected by a computer unit. The computer unit adjusts the vibration generator in the vibrating roller in such a way that a predetermined soil rigidity, that is to say the desired outcome of compaction, can be achieved. The vibration behavior is recorded by means of a plurality of measuring elements which are mounted on the roller tire serving as the soil contact element.

It has been found to be the case in various soil-compacting devices that, because of numerous external influences such as the actuation by the vibration generator, and also as a result of constantly changing soil conditions, stones, unevennesses, etc., a random, occasionally wobbling movement of the soil contact element is brought about and can only be detected using highly complex measuring equipment.

OBJECTS AND SUMMARY OF THE INVENTION

It is an object of the invention to specify a soil-compacting device with a controllable vibration generator, in which device the vibration behavior of the soil contact element can be detected in a more simple manner.

Provision is made in the soil-compacting device according to the invention for a detection mass which is connected to the soil contact element by means of an elastic coupling. The detection mass can be moved with at least one degree of freedom relative to the elastic coupling with the soil contact element, the movement of the detection mass being measured by a measuring means. A measuring signal emitted by the measuring means is evaluated in a control means and compared with a setpoint value. When a deviation is established, the control means correspondingly activates the vibration generator actuating the soil contact element.

The detection mass and the soil contact element form a mechanical filter which is used to filter substantially stochastic movements, i.e. vibrations, which prevail at the soil contact element in such a manner that it is possible, for example, for higher-frequency vibrations, that is to say vibrations with a frequency higher than the frequency predetermined by the vibration generator, to be filtered out, so that the detection mass is subject to a movement and vibration pattern which is simplified in relation to the soil contact element. To be specific, the filtering can be carried out in such a way that, although the vibrations generated as a result of the reaction to an excessive impact energy, that is to say, for example, vibrations generated by the jumping of the soil contact element, occur at the detection mass, the stochastic vibrations of the lower mass comprising the soil contact element do not.

This vibration of the detection mass can be detected in a considerably simpler manner compared with the prior art with the aid of the measuring means, so that an unambiguous measuring signal is available for the control means.

In order to refine the measuring method, the measuring means is suitable, in an advantageous development of the invention, for detecting movements of the detection mass in a plurality of spatial directions and/or directions of rotation.

In a particularly advantageous embodiment of the invention, the detection mass is formed by the upper mass. The upper mass is elastically coupled to the lower mass, so that no additional detection mass element need be provided. For this purpose, the measuring means detects the movement of the upper mass and delivers a corresponding measuring signal. By virtue of the relatively high inertia of the upper mass, the filter action is used with particular advantage. The structure can be realized in a simple manner since only one measuring means need be mounted on the upper mass.

The movement measured by the measuring means is preferably an acceleration of the detection mass, since acceleration values can be measured particularly simply.

BRIEF DESCRIPTION OF THE DRAWING

These and other advantages and features of the invention are explained in more detail below with the aid of the accompanying FIGURE and with reference to a preferred exemplary embodiment.

The single FIGURE shows a vibrating plate according to the invention which is used as a soil-compacting device.

DETAILED DESCRIPTION OF THE PREFERRED EMBODIMENTS

Figure 1:
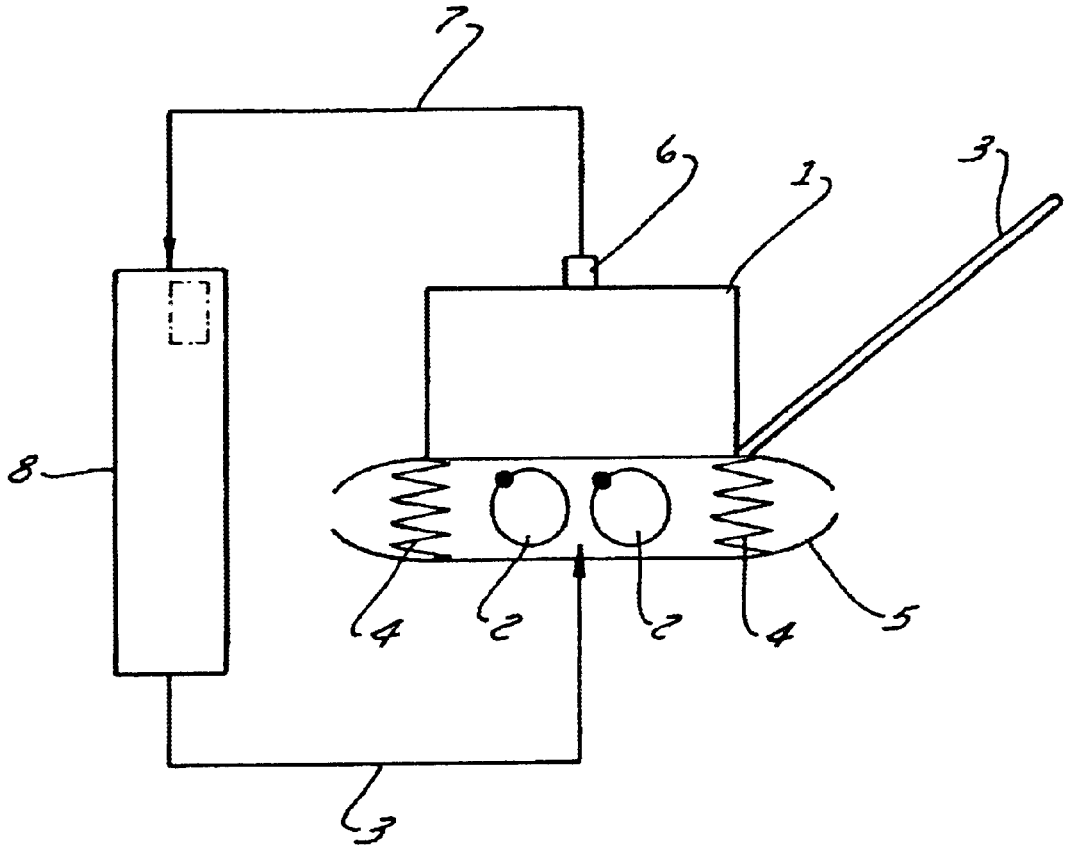

The vibrating plate has an upper mass 1 which substantially comprises a drive (not shown) for a vibration generator 2, a fuel tank, a cover and various control units and also a draw bar 3 for guiding the vibrating plate.

A soil contact plate 5 is elastically coupled to the upper mass 1 via elastic elements 4, for example rubber springs. The soil contact plate 5 is a key component of a lower mass in which, however, the vibration generator 2 is also to be included.

Mounted on the upper mass 1 is an acceleration sensor 6 which detects the acceleration of the upper mass 1 in the direction of at least one degree of freedom, but also, depending on the embodiment, in the direction of a plurality of degrees of freedom, and emits a corresponding measuring signal 7 to a control means 8. In this arrangement, at least one movement of the upper mass 1 should be detected in the vertical direction. Instead of the measurement of the acceleration by the acceleration sensor 6, it may also be advantageous in other embodiments to detect another form of movement, for example the velocity of the upper mass 1. For this purpose, it would then be necessary, if appropriate, to provide a corresponding sensor and associated algorithms in the control means 8.

The measuring signal 7 is evaluated in the control means 8.

Because an uncoupling takes place in terms of vibration between the upper mass 1 and the soil contact plate 5 due to the elastic elements 4, the upper mass 1 remains relatively calm during normal operation of the vibrating plate, even if the soil contact plate 5 constantly executes random, occasionally wobbling movements. Owing to its relatively large mass, the inertia of the upper mass 1 is conductive to this behavior.

It is only in special operating states, such as, for example, jumping of the soil contact plate 5 on an excessively hard soil or in the case of excessively high vibration energy due to the vibration generator 2, that the movement of the upper mass 1 is intensified, with the result that increased acceleration values can be established on it. These values have a corresponding effect on the measured values of the acceleration sensor 6.

The measuring signal 7 is electronically evaluated as an actual value in the control means 8 by means of a computational method. In this case, it has proved to be particularly suitable for the actual value for there to be a determination of an effective value which is determined in the form of a root mean square value (RMS value). Of course, other known signal evaluation methods which preferably deliver a characteristic actual or effective value as the result are also conceivable.

The effective value is compared with a setpoint value by the control means 8. On the one hand, the setpoint value can be influenced by the operator. However, it is also possible for the setpoint value to be stipulated by the manufacturer and permanently programmed into the control means 8.

On the basis of a comparison of the effective value with the setpoint value and a deviation established in the process, the control means 8 activates the vibration generator 2 via a control signal 9. The aim of the activation is to alter the vibration energy, which can be achieved by various measures known per se.

The vibration energy is substantially altered by adaptation of the frequency or amplitude of the vibration generator 2.

It is possible to increase or decrease the amplitude, that is to say what is called the mr value (mass x radius of the unbalance), by, for example, adjustment of the unbalanced mass on the shaft bearing it, for which purpose numerous devices are known. The case may be mentioned, by way of example, where a shaft has arranged on it two unbalanced elements which can be rotated relative to one another and whose unbalance moment alters depending on the relative position. Another case is what can be referred to as a one-side centrifugal governor, in which the unbalance can be adjusted by displacing the unbalanced mass when there is a change in the speed of rotation of the shaft.

It is possible to alter the frequency on the premise of a constant centrifugal force in which the speed of rotation of the generator is controlled as a function of the set amplitude such that the product of the amplitude (mr value) and the square of the frequency, that is to say the resulting centrifugal force, always corresponds to a predetermined, constant value. It is possible to change the speed of rotation of the generator in a mechanical drive, for example via a V-belt drive with adjustable belt pulley diameters. In a hydraulic drive, a corresponding adjustable axial piston pump is to be provided on the drive motor. In the case of an electric drive, a corresponding adaptation of the speed of rotation, for example via a frequency converter, has to take place.

In a particularly simple embodiment of the invention, the setpoint value stored in the control means is a threshold value, and, when the effective value exceeds this threshold value, the control means 8 directly controls a reduction in the vibration energy by means of the vibration generator 2. This makes it possible, for example, to prevent the soil contact plate 5 from jumping right from the outset.

In another embodiment of the invention, the control means 8 activates the vibration generator 2 as a function of the effective value exceeding or falling below the setpoint value, in order to constantly keep the soil-compacting operation in an optimum range.

In the embodiments described so far, the detection mass provided according to the invention was formed by the upper mass 1. As an alternative to this, it is, however, also possible to elastically couple an additional detection mass element to the lower mass, i.e. to the soil contact plate 5. For this purpose, the detection mass element should be of relatively small design and be able to be accommodated in a small housing on the soil contact plate 5.

The invention can be applied equally well in vibrating plates corresponding to the embodiment shown as in a vibrating roller in which the soil contact element is a roller tire.

The arrangement of the detection mass and the soil contact element 5 allows a mechanical filtering operation which replaces an elaborate electronic filtering operation which can only be implemented by means of additional structural elements. If the detection mass is formed by the upper mass, virtually no additional component whatsoever is required. On the contrary, it is possible for the acceleration sensor selected to be, by comparison with the prior art, a more simple sensor, since the vibrations to be detected also assume a more simple time profile. The evaluation and control algorithms in the control means 8 can also be designed in a more simple and less time-critical manner.

The effective avoidance of inadmissible vibrations, i.e. accelerations of the upper mass, prevents not only damage to the appliance and, in particular, to the drive as a result of excessively high loading. At the same time, hand and arm vibrations endured by the operator are reduced and kept within predetermined limits. The consequence of this is more relaxed and more effective working.

What is claimed is:

1. A soil-compacting device, comprising:

a lower mass having a soil contact element for the purpose of soil compaction;

a vibration generator which actuates the soil contact element; and comprising an upper mass which is elastically connected to the lower mass and has a drive for the vibration generator;

a detection mass connected to the soil contact element via an elastic coupling, wherein the detection mass can be moved with at least one degree of freedom relative to the elastic coupling with the soil contact element;

a measuring means for measuring the movement of the detection mass in the direction of at least the one degree of freedom and emits a measuring signal;

a control means for the purpose of evaluating the measuring signal to give an actual value, comparing the actual value with a setpoint value and activating the vibration generator in a way corresponding to a deviation of the actual value from the setpoint value.

2. The soil-compacting device as claimed in claim 1, wherein the setpoint value is a threshold value, and, when the actual value exceeds the threshold value, the control means controls a reduction of the vibration energy via the vibration generator.

3. The soil-compacting device as claimed in claim 1, wherein when the actual value exceeds or falls below a range defined around the setpoint value, the control means controls a change in the vibration energy via the vibration generator.

4. The soil-compacting device as claimed in claim 2, wherein the vibration produced by the vibration generator can be altered with respect to its frequency and/or its amplitude by the control means.

5. The soil-compacting device as claimed in claim 1, wherein the measuring means is suitable for detecting movements in a plurality of spatial directions and/or directions of rotation.

6. The soil-compacting device as claimed in claim 1, wherein the detection mass is formed by the upper mass.

7. The soil-compacting device as claimed in claim 1, wherein the movement of the detection mass measured by the measuring means is an acceleration.

8. The soil-compacting device as claimed in claim 1, wherein the soil-compacting device is a vibrating plate and the soil contact element is a soil contact plate.

9. The soil-compacting device as claimed in claim 1, wherein the soil-compacting device is a vibrating roller and the soil contact element is a roller tire.

10. A hand-held soil compacting device, comprising:

a lower mass having a soil contact element configured to compact soil;

a vibration generator which actuates the soil contact element;

an upper mass which is elastically connected to the lower mass and which has a drive for the vibration generator;

a detection mass connected to the soil contact element via an elastic coupling, wherein the detection mass moves with at least one degree of freedom relative to the elastic coupling with the soil contact element;

measuring means for measuring a movement of the detection mass in the direction of the at least the one degree of freedom and emits a measuring signal; and control means for:

evaluating the measuring signal to give an actual value of the movement of the detection mass, comparing the actual value of movement with a setpoint value, and altering an operational parameter of the vibration generator to alter a vibration amplitude in a way corresponding to a deviation of the actual value from the setpoint value.

11. The hand-held soil compacting device as claimed in claim 10, wherein the setpoint value is a threshold value, and, when the actual value of the movement of the detection mass exceeds the threshold value, the control means controls a reduction in the amplitude of vibration via the vibration generator.

12. The hand-held soil-compacting device as claimed in claim 10, wherein, when the actual value falls below a range defined around the setpoint value, the control means controls an increase in the amplitude of vibration via the vibration generator.

13. The hand-held soil-compacting device as claimed in claim 11, wherein a vibration energy produced by the vibration generator is altered with by the control means with respect to its frequency and the amplitude of vibration.

14. The hand-held soil-compacting device as claimed in claim 10, wherein the measuring means detects movements in a plurality of spatial directions and/or directions of rotation.

15. The hand-held soil-compacting device as claimed in claim 10, wherein the detection mass is formed by the upper mass.

16. The hand-held soil-compacting device as claimed in claim 10, wherein the movement of the detection mass measured by the measuring means is an acceleration of the detection mass.

17. The hand-held soil-compacting device as claimed in claim 10, wherein the hand-held soil compacting device is a vibrating plate and the soil contact element is a soil contact plate.

18. The hand-held soil-compacting device as claimed in claim 10, wherein the hand-held soil-compacting device is a vibrating roller and the soil contact element is a roller tire.

* * * * *